US006755288B1

(12) United States Patent
Lai

(10) Patent No.: US 6,755,288 B1
(45) Date of Patent: Jun. 29, 2004

(54) LUGGAGE STRUCTURE

(76) Inventor: Allen Lai, No. 5, Lane 210, Hoping Rd., Tantze Hsiang, Taichung County (TW)

( * ) Notice: Subject to any disclaimer, the term of this patent is extended or adjusted under 35 U.S.C. 154(b) by 0 days.

(21) Appl. No.: 10/322,550

(22) Filed: Dec. 19, 2002

(51) Int. Cl.[7] ..... A45C 13/04; A45C 13/36

(52) U.S. Cl. ..... 190/24; 190/122; 190/125; 190/127

(58) Field of Search ..... 190/24, 25, 28, 190/40, 124, 122, 125, 127

(56) References Cited

U.S. PATENT DOCUMENTS 2,716,473 A * 8/1955 Droutman ..... 190/119
3,335,827 A * 8/1967 Hofferbert ..... 190/125
3,477,553 A * 11/1969 Kish, Jr. ..... 190/119
3,741,355 A * 6/1973 Slan ..... 190/124
3,938,630 A * 2/1976 March ..... 190/24
4,004,664 A * 1/1977 Pelavin et al. ..... 190/127
4,199,045 A * 4/1980 Machler ..... 190/121
4,796,735 A * 1/1989 Horiuchi ..... 190/109
4,823,924 A * 4/1989 Goodin ..... 190/119
5,168,968 A * 12/1992 Fritze ..... 190/28
5,252,161 A * 10/1993 Chang et al. ..... 156/196
6,260,680 B1 * 7/2001 Lin ..... 190/119
6,325,189 B1 * 12/2001 King et al. ..... 190/119

FOREIGN PATENT DOCUMENTS

EP 0228304 A2 * 7/1987 ..... 190/124

* cited by examiner

*Primary Examiner*—Sue A. Weaver
(74) *Attorney, Agent, or Firm*—Rosenberg, Klein & Lee

(57) ABSTRACT

A luggage structure is disclosed to include a hard plastic body internally decorated with a curtain, a metal reinforcing inner frame and a metal reinforcing outer frame respectively fastened to inner and outer diameters of the hard plastic body, a flexible supplementary frame attached to the topmost edge of the hard plastic body and riveted to the metal reinforcing inner frame, a fabric cover fastened to the flexible supplementary frame and adapted to close/open the luggage, and a fabric shell riveted to the metal reinforcing outer frame and covered over the flexible supplementary frame.

2 Claims, 3 Drawing Sheets

LUGGAGE STRUCTURE

BACKGROUND OF THE INVENTION

1. Field of the Invention

The present invention relates to a luggage and, more particularly to a luggage structure, which has a hard plastic body reinforced with metal reinforcing frames and covered with a fabric shell, and a fabric cover adapted to close/open the hard plastic body.

2. Description of the Related Art

Regular luggage include two types, one having a hard shell, and the other having a soft shell. A hard shell for luggage is directly molded from plastic resin. A soft shell for luggage is made from fabric sheet material. A hard shell for luggage has a high impact resistant value. However, a luggage having a hard shell is heavy, not collapsible, and not convenient for carrying by hand or on the shoulder. A luggage having a soft shell is collapsible, however the soft shell has a low impact resistant value. Either of hard shell type or soft shell type, conventional luggage have no specially designed reinforcing means to reinforce the strength of the shell.

SUMMARY OF THE INVENTION

The present invention has been accomplished under the circumstances in view. It is one object of the present invention to provide a luggage structure, which has the advantages of a luggage having a hard shell and the advantages of a luggage having a soft shell. It is another object of the present invention to provide a luggage structure, which has a high impact resistant value, and provides a soft and warm touch. According to one aspect of the present invention, the luggage structure comprises a hard plastic body internally decorated with a curtain, a metal reinforcing inner frame and a metal reinforcing outer frame respectively fastened to inner and outer diameters of the hard plastic body, a flexible supplementary frame attached to the topmost edge of the hard plastic body and riveted to the metal reinforcing inner frame, a fabric cover fastened to the flexible supplementary frame and adapted to close/open the luggage, and a fabric shell riveted to the metal reinforcing outer frame and covered over the flexible supplementary frame. According to another aspect of the present invention, an integrated metal reinforcing frame may be used instead of the metal reinforcing inner frame and the metal reinforcing outer frame.

DETAILED DESCRIPTION OF THE PREFERRED EMBODIMENT

Figures 1A, 1B, 1C:
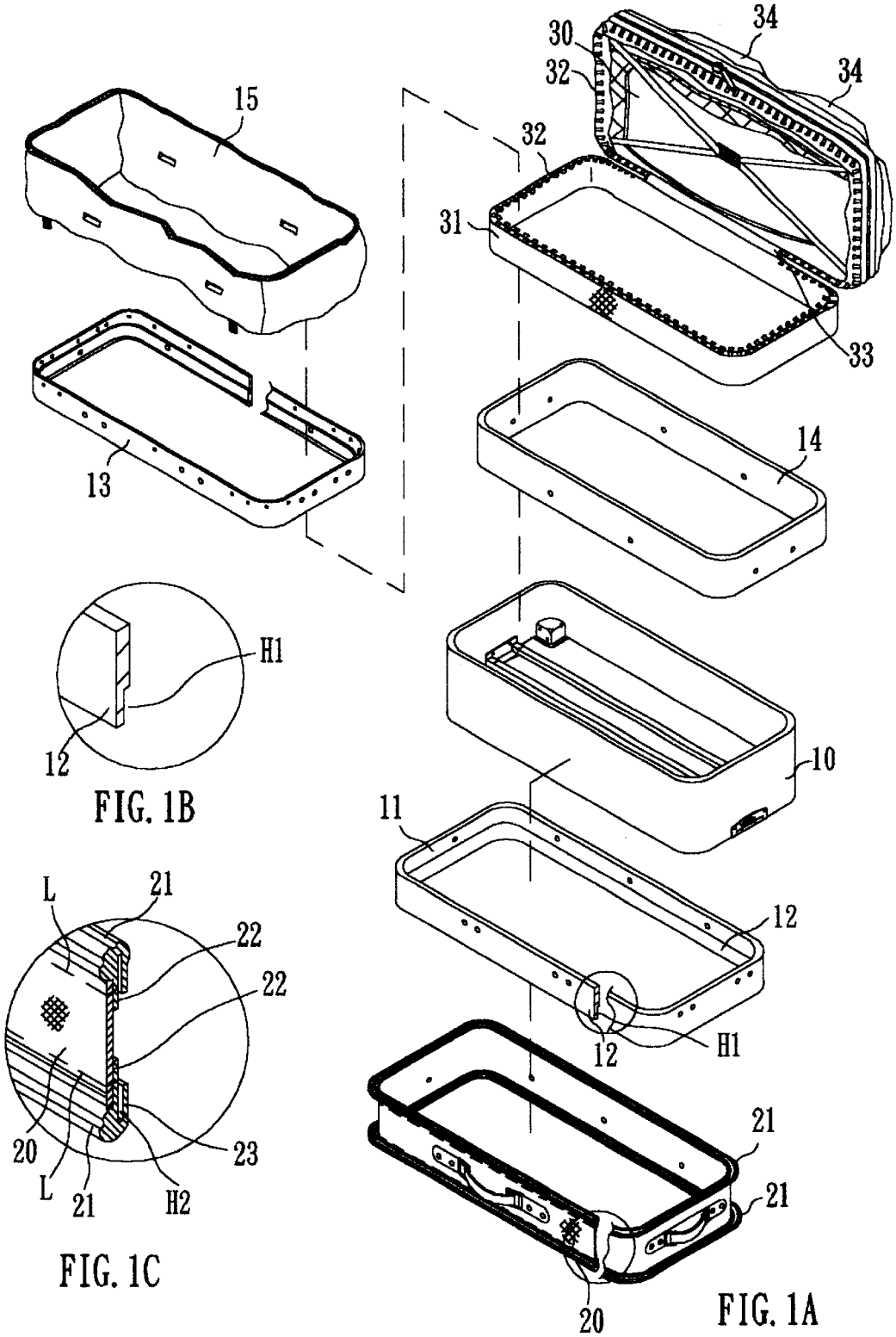
FIG. 1A is an exploded view of a luggage structure according to the present invention.
FIG. 1B is an enlarged view of a part of the metal reinforcing outer frame shown in FIG. 1A.
FIG. 1C is an enlarged view of a part of the fabric shell shown in FIG. 1A.
Figure 2B:
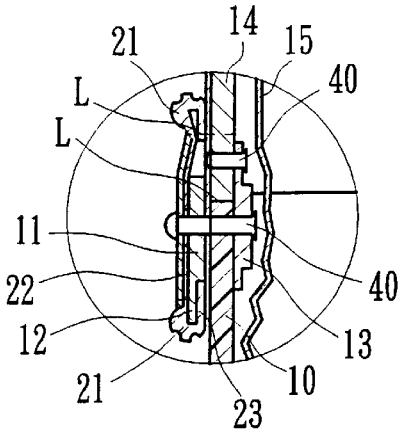
FIG. 2B is an enlarged view of a part of FIG. 2A.
Figure 2A:
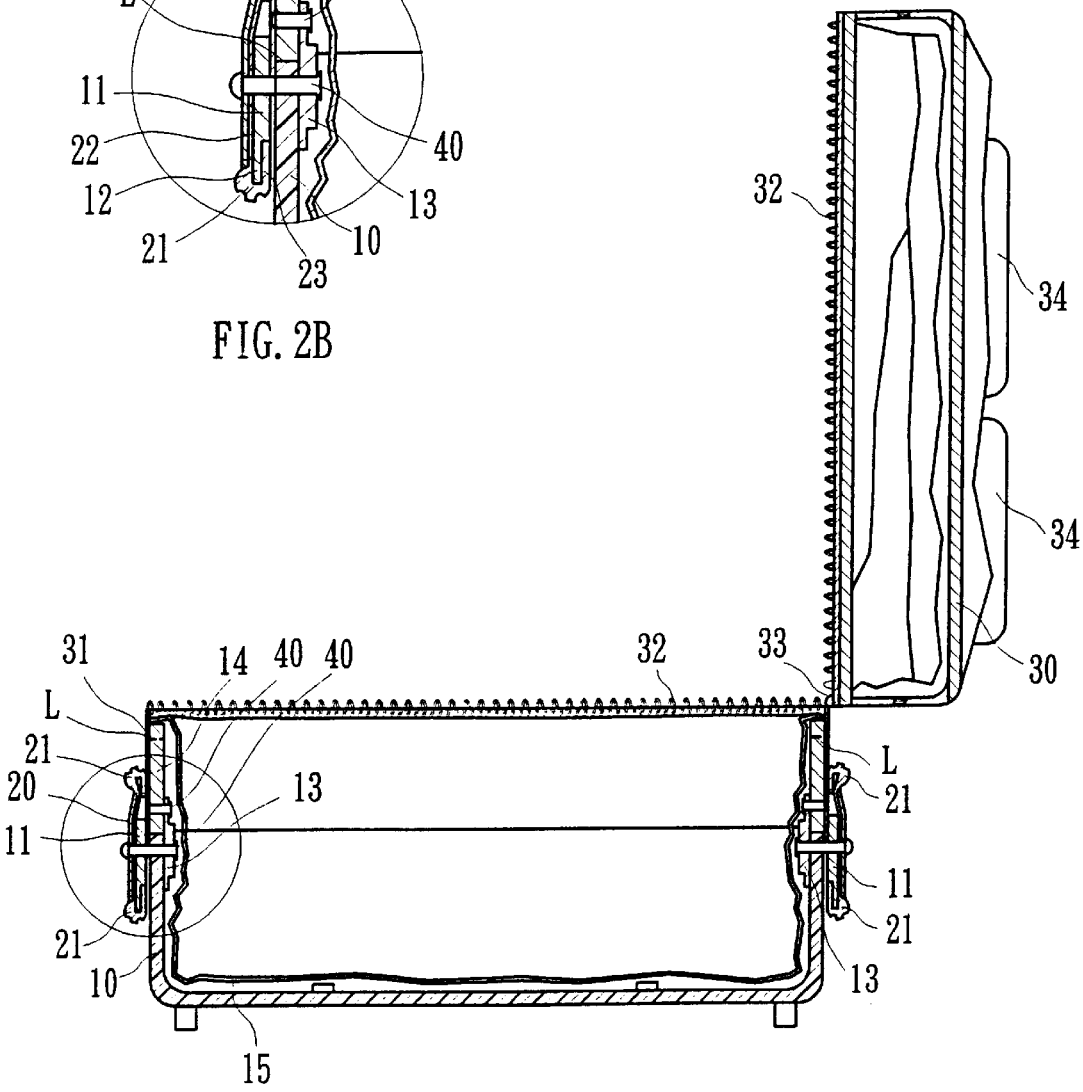
FIG. 2A is a sectional assembly view of the present invention.

Referring to FIGS. 1A, 1B, 1C, 2A, and 2B, a luggage structure in accordance with the present invention is shown comprised of a hard plastic body 10, a fabric cover 30, a metal reinforcing inner frame 13, a metal reinforcing outer frame 11, a flexible supplementary frame 14, and a fabric shell 20.

The hard plastic body 10 is a hollow rectangular top-open case injection-molded from plastics and internally decorated with a curtain 15. The metal reinforcing inner frame 13 and the metal reinforcing outer frame 11 are respectively made from aluminum, and respectively attached to the inner and outer peripheries of the hard plastic body 10 and secured thereto by rivets 40. When installed, the flanged top rim of the metal reinforcing inner frame 13 protrudes over the topmost edge of the hard plastic body 10. The flexible supplementary frame 14 is attached to the topmost edge of the hard plastic body 10 and riveted to the flanged top rim of the metal reinforcing inner frame 13. The metal reinforcing outer frame 11 has a thinner lower part 12 defining an inner groove H1. The fabric cover 30 comprises a connecting flap 33 extended along one side, a mounting portion 31 connected to the connecting flap 33 and covered over the surface of the flexible supplementary frame 14 and fixedly secured thereto by stitches L, and a zip fastener 32 provided at the fabric cover 30 and the mounting portion 31 for closing/opening the fabric cover 30. Further, the fabric cover 30 has pockets 34 on the outside for keeping small items. The fabric shell 20 has two rubber packing strips 21 respectively fastened to the top and bottom sides by stitches L, and two stitching flaps 22 respectively fastened to the rubber packing strips 21. Each rubber packing strip 21 has a clamping portion 23, which defines with the corresponding stitching flap 22 a clamping groove H2. The clamping portions 23 of the rubber packing strips 21 of the fabric shell 20 are respectively clamped on the mounting portion 31 of the fabric cover 30 against the flexible supplementary frame 14 and the thinner lower part 12 of the metal reinforcing outer frame 11, enabling the stitching flaps 22 to be stitched to the mounting portion 31 of the fabric cover 30 and the flexible supplementary frame 14. Further, the middle part of the fabric shell 20 is riveted to the metal reinforcing outer frame 11.

As indicated above, the luggage structure of the present invention has the following advantages:

1. Perfect match of hard and soft materials. The hard plastic body is strong and durable in use, and the soft fabric cover gives a soft, comfortable touch.
2. High impact resistant value. The hard plastic body is reinforced with metal reinforcing inner and outer frames to increase the structural strength of the luggage.
3. Nice looking. The fabric shell gives a warm, nice looking.

Figure 3B:
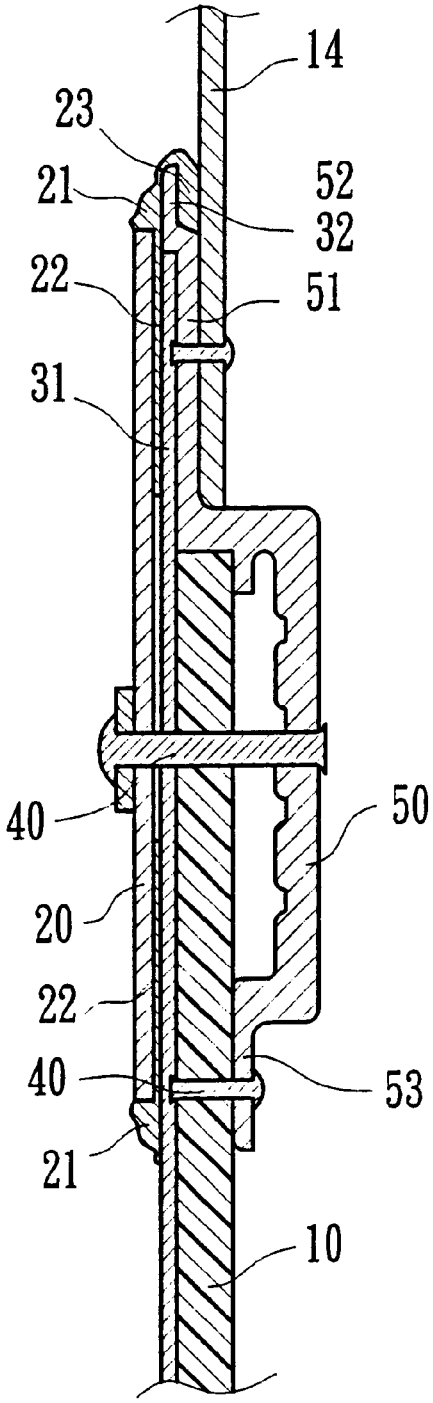
FIG. 3B is a sectional assembly view of a part of the alternate form of the present invention.
Figure 3A:
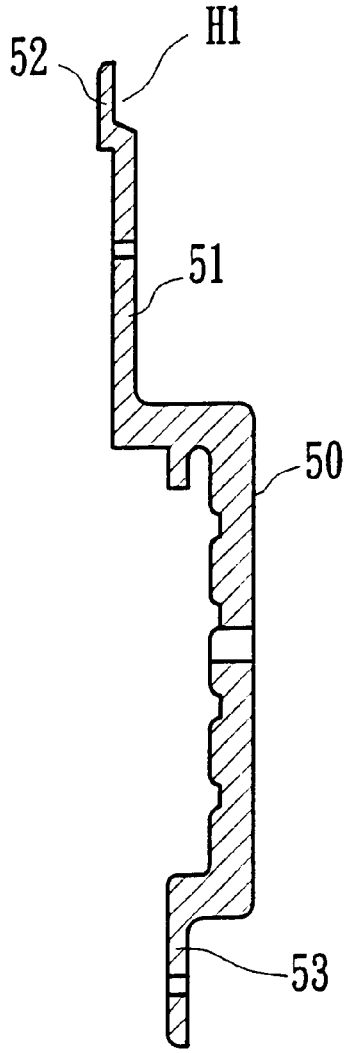
FIG. 3A is a sectional view of an alternate form of the present invention, showing the structure of the metal reinforcing frame.

Further, the metal reinforcing inner and outer frames may be made in integrity as shown in FIGS. 3A and 3B. As illustrated, the metal reinforcing frame, referenced by 50, comprises an outer reinforcing frame portion 51 fastened to the hard plastic body 10, an inner reinforcing frame portion 53 fastened to the flexible supplementary frame 14, and an outer extension portion 52 extended from the outer reinforcing frame portion 51 and defining with the body 10 a gap H1 for receiving the clamping portion 23 of one packing strip 21 of the fabric shell 20.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A luggage structure comprising:

a hard plastic body, said hard plastic body being a hollow rectangular top-open case injection-molded from plastics and internally decorated with a curtain;

a metal reinforcing inner frame and a metal reinforcing outer frame respectively attached to inner and outer peripheries of said hard plastic body and secured thereto by rivets, said metal reinforcing inner frame having a flanged top rim protruding over the topmost edge of said hard plastic body, said metal reinforcing outer frame having a thinner lower part;

a flexible supplementary frame attached to the topmost edge of said hard plastic body and riveted to the flanged top rim of said metal reinforcing inner frame;

a fabric cover, said fabric cover comprising a connecting flap extended along one side thereof, a mounting portion connected to said connecting flap and covered over said flexible supplementary frame and fixedly secured to said flexible supplementary frame by stitches, and a zip fastener provided at said fabric cover and said mounting portion for closing/opening said fabric cover; and a fabric shell riveted to said metal reinforcing outer frame, said fabric shell having two rubber packing strips respectively located on top and bottom sides thereof, and two stitching flaps respectively extended from said packing strips and respectively stitched to the mounting portion of said fabric cover and said flexible supplementary frame, said rubber packing strips each having a clamping portion respectively clamped on the mounting portion of said fabric cover against said flexible supplementary frame and the thinner lower part of said metal reinforcing inner frame.

2. A luggage structure comprising:

a hard plastic body, said hard plastic body being a hollow rectangular top-open case injection-molded from plastics and internally decorated with a curtain;

a metal reinforcing frame, said metal reinforcing frame comprising an outer reinforcing frame portion riveted to said hard plastic body, an inner reinforcing frame portion, and an outer extension portion extended from said outer reinforcing frame portion, said metal reinforcing frame extending about the periphery of said hard plastic body;

a flexible supplementary frame attached to the topmost edge of said hard plastic body and riveted to the inner reinforcing frame portion of said metal reinforcing frame;

a fabric cover, said fabric cover comprising a connecting flap extended along one side thereof, a mounting portion connected to said connecting flap and covered over said flexible supplementary frame and fixedly secured to said flexible supplementary frame by stitches, and a zip fastener provided at said fabric cover and said mounting portion for closing/opening said fabric cover; and a fabric shell riveted to the outer reinforcing portion of said metal reinforcing frame, said fabric shell having two rubber packing strips respectively located on top and bottom sides thereof, and two stitching flaps respectively extended from said packing strips and respectively stitched to the mounting portion of said fabric cover and said flexible supplementary frame, said rubber packing strips each having a clamping portion respectively clamped on the mounting portion of said fabric cover against said flexible supplementary frame and the outer extension portion of said metal reinforcing frame.

* * * * *